US007267324B2

(12) United States Patent
Young

(10) Patent No.: US 7,267,324 B2
(45) Date of Patent: Sep. 11, 2007

(54) RANCH FENCE

(76) Inventor: Warren F. Young, 415 S. Boston, Suite 510, Tulsa, OK (US) 74103

( * ) Notice: Subject to any disclaimer, the term of this patent is extended or adjusted under 35 U.S.C. 154(b) by 602 days.

(21) Appl. No.: 10/345,461

(22) Filed: Jan. 17, 2003

(65) Prior Publication Data

US 2003/0127638 A1 Jul. 10, 2003

Related U.S. Application Data

(63) Continuation-in-part of application No. 09/481,923, filed on Jan. 13, 2000, now abandoned.

(51) Int. Cl.
*E04H 17/14* (2006.01)
*E04H 17/20* (2006.01)

(52) U.S. Cl. ..... 256/65.02; 256/19; 256/21; 256/60

(58) Field of Classification Search ..... 256/1, 256/19, 21, 59, 60, 65.01, 65.02, 65.11; 70/159, 70/166

See application file for complete search history.

(56) References Cited

U.S. PATENT DOCUMENTS

| | | | | | |
|---|---|---|---|---|---|
| 133,853 | A | * | 12/1872 | Hall | 256/59 |
| 195,243 | A | * | 9/1877 | Albaum | 70/166 |
| 2,800,305 | A | * | 7/1957 | Gerstner | 256/65.05 |
| 3,357,681 | A | * | 12/1967 | Souza, Jr. | 256/65.02 |
| 3,921,960 | A | * | 11/1975 | Bright | 256/65.12 |
| 3,955,801 | A | * | 5/1976 | Soriero, Jr. | 256/65.13 |
| 3,993,289 | A | * | 11/1976 | Lewis et al. | 256/65.03 |
| 4,240,278 | A | * | 12/1980 | Linder | 70/101 |
| 4,468,940 | A | * | 9/1984 | Davis | 70/159 |
| 4,477,059 | A | * | 10/1984 | Willis | 256/65.11 |
| 4,722,514 | A | * | 2/1988 | Pettit | 256/19 |
| 4,910,933 | A | * | 3/1990 | Schwarzfeller et al. | 256/47 |
| 5,100,109 | A | * | 3/1992 | Robbins, III | 256/59 |
| 5,421,556 | A | * | 6/1995 | Dodge et al. | 256/1 |
| 5,503,496 | A | * | 4/1996 | Voigt | 404/10 |
| 5,593,141 | A | * | 1/1997 | Cain et al. | 256/26 |
| 5,853,167 | A | * | 12/1998 | West et al. | 256/66 |
| 6,006,558 | A | * | 12/1999 | Peters | 70/63 |
| 6,467,756 | B1 | * | 10/2002 | Elsasser | 256/65.14 |

FOREIGN PATENT DOCUMENTS

FR 1401359 * 12/1965

* cited by examiner

*Primary Examiner*—Daniel P. Stodola
*Assistant Examiner*—Ernesto Garcia
(74) *Attorney, Agent, or Firm*—William S. Dorman

(57) ABSTRACT

An interlocking steel fencing system having posts and rails made from tubular steel, the posts and rails being either round or rectangular in shape, the posts having openings therein which correspond with the shape of a rail designed to be inserted therein, the end posts being provided with openings only on one side thereof, while in-line posts are provided with openings parallel to one another and corner posts are provided with openings in ninety-degree relation to one another, the end posts and corner posts being provided with spacer bars therein with which the rails are firmly abutted during assembly, and these posts being further provided with a locking cap to prevent removal of the spacer bars, the fencing system designed to be assembled such that each rail abuts the adjacent rail at a central location within the post or, on an end or corner post, abuts a spacer bar within the post and wherein the post openings are slightly larger than the rails to allow the fencing system to traverse uneven topography.

5 Claims, 5 Drawing Sheets

RANCH FENCE

The instant application is a Continuation-in-Part of application Ser. No. 09/481,923, filed Jan. 13, 2000 now abandoned.

BACKGROUND OF THE INVENTION

1. Field of the Invention

The present invention relates to fencing where the fence posts and the fence railings are both made of steel. More particularly, the present invention relates to an improved method of connection of the fence rail to the fence post which obviates the need for welding.

2. Prior Art

Wood rail fencing has been utilized traditionally for many years to enclose areas of real estate. Typically, the main purpose of such fencing is to enclose and retain animals within a given space. Recently, manufacturers and installers of fencing have proposed plastic components for the fences, such plastic materials including, for example, polyvinyl chloride (PVC) compounds in the manufactured fence components. The recent interest in the PVC fencing is occasioned by the apparent more attractive appearance of PVC fencing as compared to wood fencing. However, PVC fencing is generally not as rigid and is subject to deterioration and colors lost by ultraviolet exposure. The present invention proposed the use of square or round steel posts in the form of tubing which is provided with openings to allow the insertion of pre-cut steel rails.

A preliminary search was conducted on the above invention and the following listed patents were uncovered.

| Inventor | U.S. Pat. No. | Date |
|---|---|---|
| Lawrence | 5,645,270 | Jul. 8, 1997 |
| German | 5,161,783 | Nov. 10, 1992 |
| Colton | 2,856,652 | Oct. 21, 1958 |
| Baker | 5,649,688 | Jul. 22, 1997 |
| Dodge | 5,421,556 | Jun. 6, 1995 |
| Wylie | 4,854,548 | Aug. 8, 1989 |
| Mesa | 4,642,459 | Feb. 10, 1987 |
| Totten | 4,007,919 | Feb. 15, 1977 |
| Lewis et al. | 3,993,289 | Nov. 23, 1976 |

Lawrance, U.S. Pat. No. 5,645,270, discloses a system assembling a hollow post and post cap. The cap is provided with means to prevent separation of the parts.

German, U.S. Pat. No. 5,161,783 discloses a fence post and rail connection which uses a sleeve inside post to form a rigid connection.

Colton, U.S. Pat. No. 2,856,652 discloses a post and fence construction which uses spacers to fill areas between rails.

None of the patents are believed to disclose the features of the present invention, as will hereinafter appear.

SUMMARY OF THE INVENTION

A steel fencing system is provided where the posts and rails are both made from tubular steel, the posts and/or rails can be round or rectangular. The posts are provided with openings therein to allow the insertion of pre-cut steel rails. These openings, round or rectangular depending upon the shape of the rails, are cut slightly larger than the rail to allow the rails to traverse an uneven topography. The line posts are provided with openings on opposite vertical side portions to allow the insertion of rails from either side while the corner posts are provided with openings on a 90-degree angle. End or termination posts are provided with openings on only one side portion thereof. The fence is designed so that an installer can set an initial end post or, alternatively, into a corner post, insert a spacer bar into the end post and insert the rails into the end post such that each rail abuts the spacer bar, after which the next post position may be determined by inserting the free ends of the rails therein to a point of insertion halfway into the second post and then digging a hole for the post and/or setting the post, and continuing in this manner until the last post has been set. The final end post will be provided with a spacer bar in the same manner as the initial end post.

The fence is further designed so that an installer can set the posts and insert the rails without welding. Since there is no welding required, this allows the posts and rails to be pre-painted or powder coated at the user's option. As the fence is assembled it is designed so that all the rails may be pushed snugly against each other in the in-line post. On the end or corner posts a spacer is inserted so that it will take up a space slightly larger than would normally be occupied by another abutting rail. Depending upon the manner in which the corner posts are arranged, a similar spacer might be inserted in a corner post. At any event, a locking post cap is installed on the spacer post to prevent anyone from coming in and removing the spacer and then thereafter the individual rails. Conversely, the locking cap is advantageous over a welded cap because the locking cap permits the owner of the fence to remove the locking cap, remove the spacer bar, and slide each individual rail toward an end post or corner post such that the rails are removable to facilitate ease of replacement of damaged rails or, for example, replacement of a section of the fence with a gate. The result is an interlocking fencing system which requires no welding, is anti-theft and is user friendly for repair, replacement or modification.

DETAILED DESCRIPTION OF THE PREFERRED EMBODIMENTS

Figure 1:
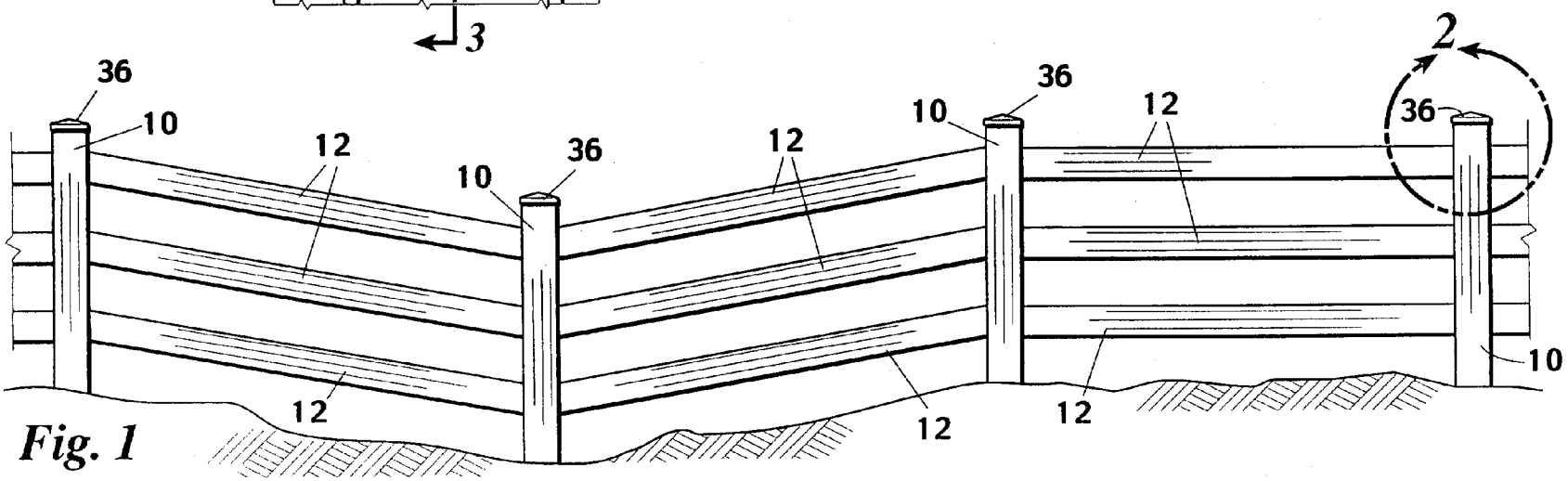
FIG. 1 is side elevation of a ranch fence made in accordance with the present invention, and illustrating the ability of the fence to traverse uneven and relatively even topography.

Referring to the drawings, FIG. 1 shows a fence composed of vertical posts 10 and horizontal rails 12. In the embodiment shown in these drawings both the posts and the rails are hollow rectangular steel tubes. However, both the posts and the rails can be round tubing if desired or any combination thereof.

Figure 13:
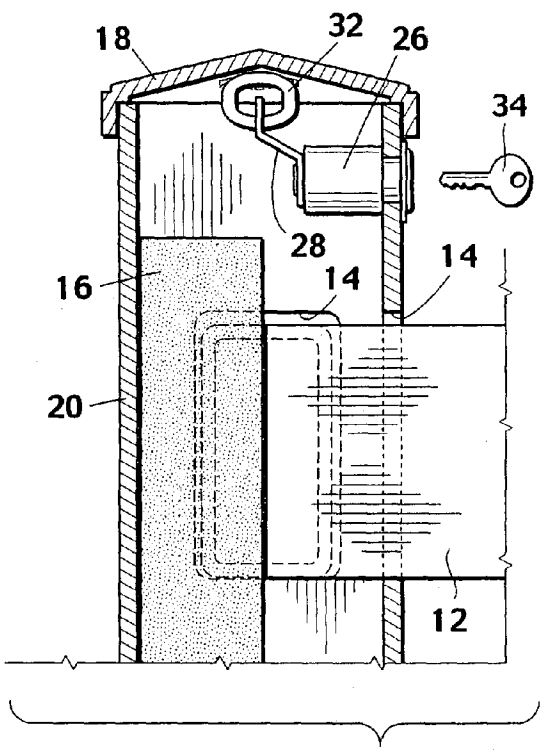
FIG. 13 is a view similar to FIG. 8 but taken along section line 13-13 of FIG. 11.
Figure 4:
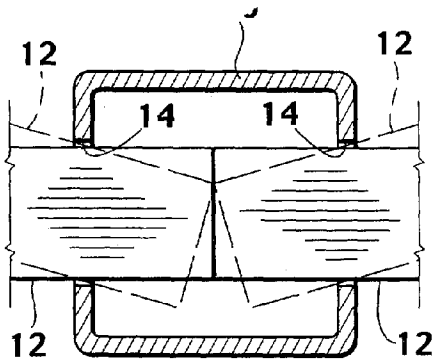
FIG. 4 is a sectional view taken along section line 4-4 of FIG. 2 and showing an alternate position of the rails in dotted lines.
Figure 12:
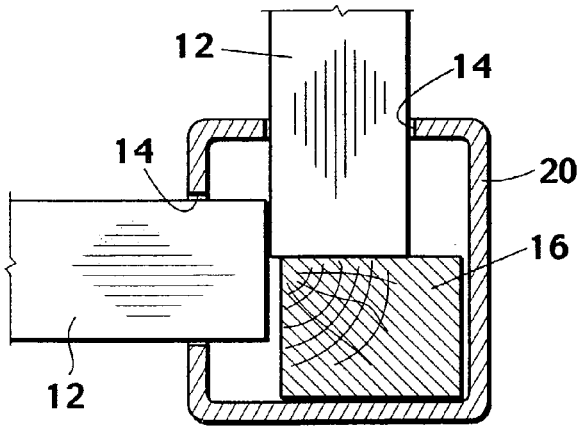
FIG. 12 is a view taken along section line 12-12 of FIG. 11.
Figure 11:
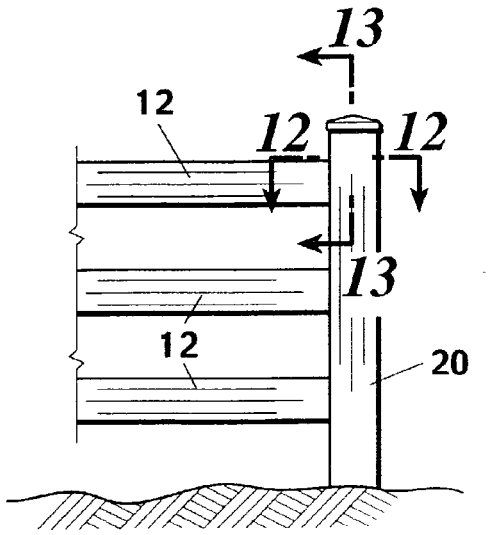
FIG. 11 is an elevation of the corner post and interconnecting rails taken from line 11-11 of FIG. 10.

The post 10 is provided with rectangular openings 14 therein. In the case of an in-line post 10 (as shown in the center portion of FIG. 1, the rectangular openings 14 are on opposite vertical side portions of the post. However, if a corner post 20 (see FIGS. 10 to 13) is employed, this post is provided with openings 14 which are on two side portions that are at right-angles to each other as shown in FIG. 4. In this case, the rails 12 will come through the respective openings at right-angles to each other and will abut as shown in FIG. 12. In the event that the abutment leaves too much space so as to permit a possible theft of the rail, a wooden spacer 16 may be employed as shown in FIGS. 12 and 13 and the post 10 may be provided with a locking cap 18 as shown in FIG. 13.

Figure 8:
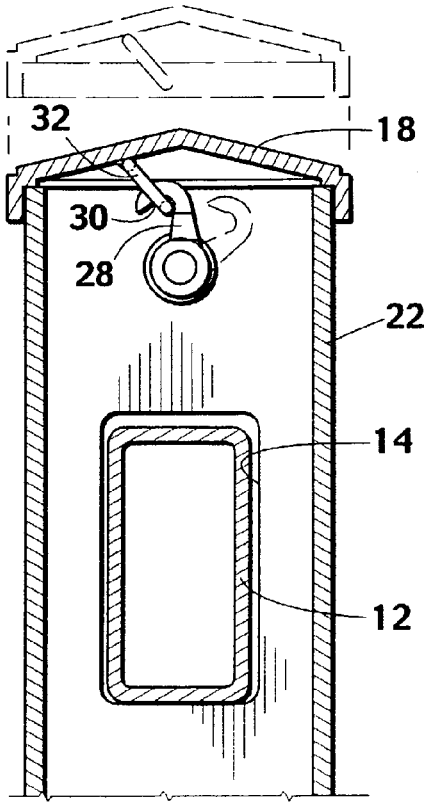
FIG. 8 is a sectional view taken along lines 8-8 of FIG. 7 and also showing a post cap in an elevated position in dotted lines.
Figure 7:
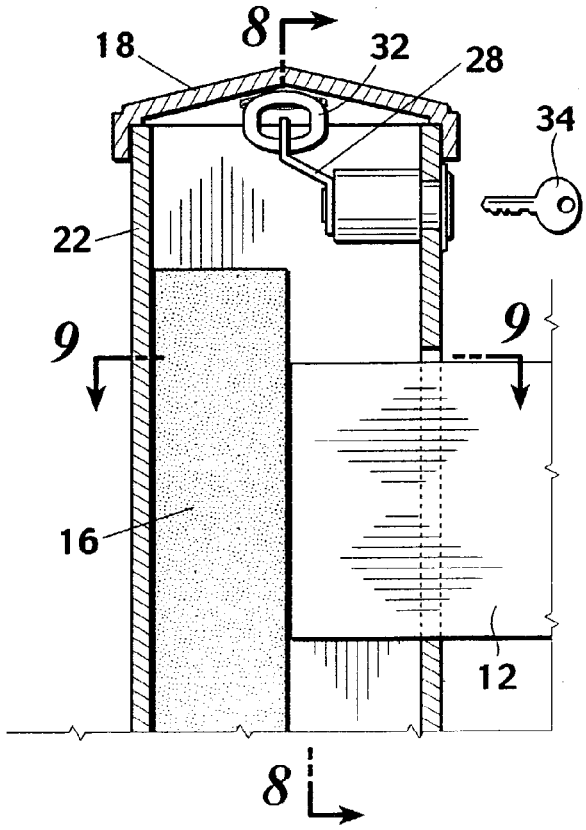
FIG. 7 is a view of an end post having a single slot for the insertion of a single rail with the remainder of the space being taken up by a wooden insert.
Figure 10:
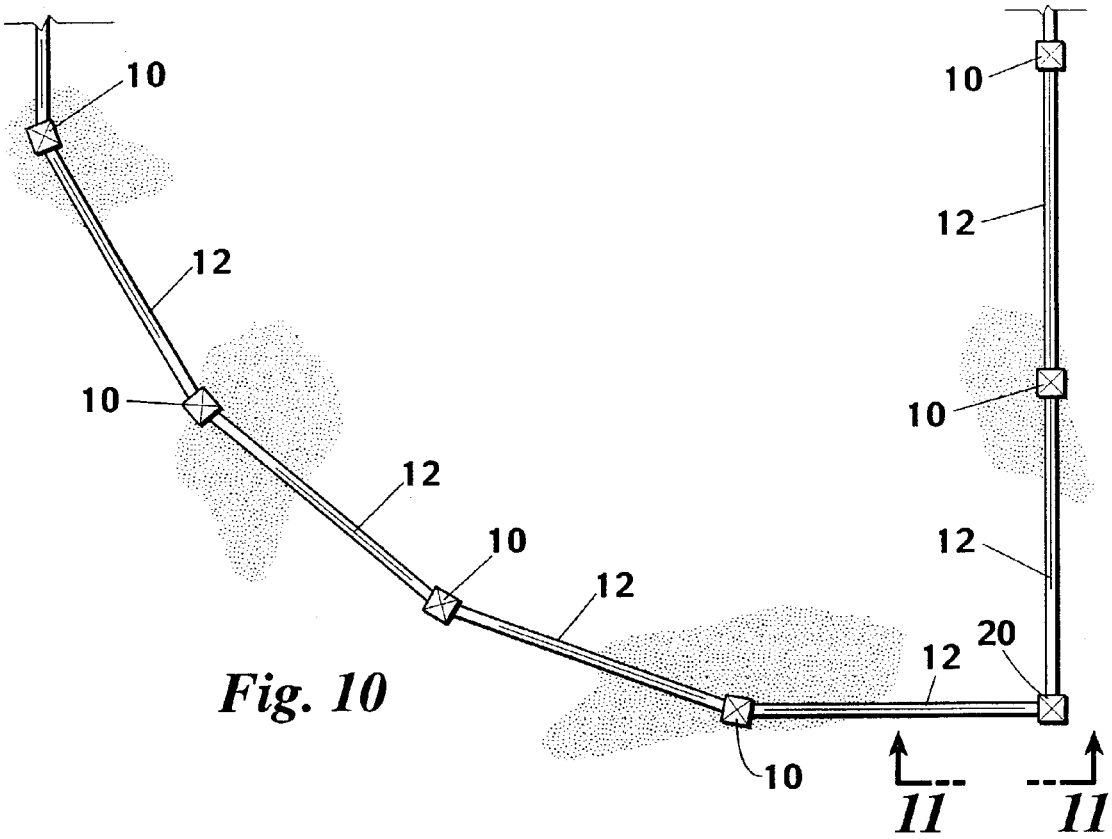
FIG. 10 is a semi-diagrammatic plan view of a fence constructed in accordance with the present invention where the portion to the left employs the customary in-line post but with the rails at angles and wherein the right-hand portion of this fence shows a section coming in to a corner post.

On the other hand, in the case of an end post (the last post in line) such as post 22 shown in FIGS. 7 and 8, there is only one side portion of the post which is provided with an opening 14 where the rail 12 can be inserted. Since the rail will only occupy the right-hand portion of the interior space in the post 22 a spacer 16 (which is nothing more that a 2×4 having a height equal to the height of the post) is inserted to the left of the end of the rail 12 so as to fill up the space which otherwise would be occupied by the end of another rail if that post had been an in-line post.

In order to prevent someone from stealing the rails by removing the spacer 16, a post cap 18 is provided with a convenient lock thereon. Purely by way of example the lock in this case consists of a shaft 26 which extends from the side of the post 22 horizontally below the upper end of the post. On the shaft is mounted a finger 28 having a hook 30 on the end.

The cap 18 has a circular eye 32 mounted thereon and extending at an angle inwardly so as to intercept the hook 30 of the finger 28 when the shaft 26 is turned. A key 34 is adapted to fit into a suitable key slot (not shown) in the shaft 26 and operates in the conventional manner of a tumbler type lock to turn the shaft 26 when the key 34 is inserted therein. After the cap 18 is locked as shown in FIG. 7 the key is removed and the cap will be locked securely in place on the top of the post 22.

In order to assemble the rails 12 into the post 10, we will assume that the post 10 to the right of center in FIG. 1 already has the left-hand rails 12 in place and that no rails as yet have been inserted in the right-most post 10. The right-hand rail 12 is now picked up and the right-hand end of it is inserted into the right-most post. The left-hand end of this rail 12 is now inserted into the right-hand opening 14 of the right center post. The same left-hand end of this rail is now pushed further into the right-hand opening 14 until it abuts the right-hand end of the rail that is already in place. The process is continued down the line towards the right until an end post 22 is reached, at which time reference should be had to the description of the end post 22 as previously set forth herein.

Each of the in-line posts 10 is provided with an ordinary cap 36 which need not be locked and which can be simply and easily removed or, in the alternative, can be tack welded onto the post. However, spacers such as spacer 16 and locking post caps such as cap 18 can be provided wherever it is desirable or necessary.

Figure 14:
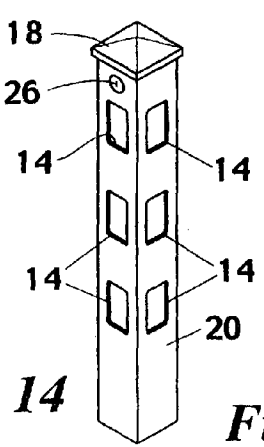
FIG. 14 is a perspective view of the corner post shown in FIG. 11.
Figure 6:
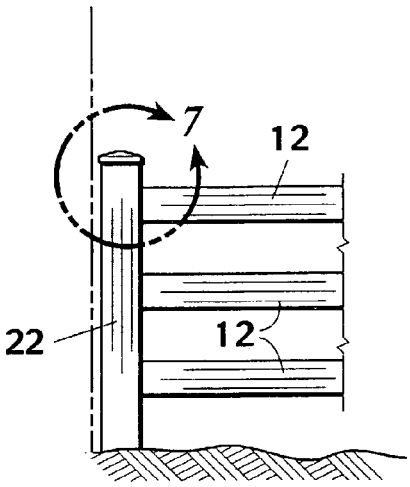
FIG. 6 is a fragmentary view of a portion of the same fence shown in FIG. 1 but showing the end post thereof.
Figure 9:
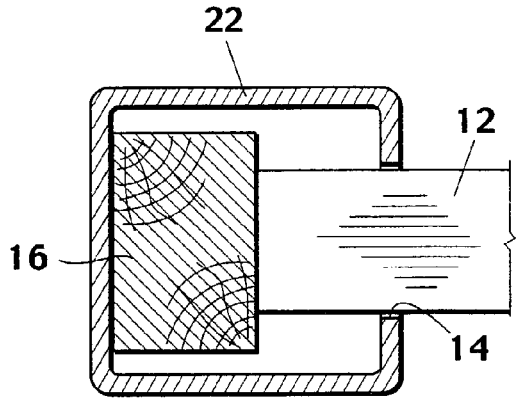
FIG. 9 is a transverse sectional view taken along section line 9-9 of FIG. 7.

Referring briefly to FIGS. 10, 11, 12 and 13, FIG. 10 shows a plan view of a fence where the in-line posts 10 are arranged so that the intervening rails 12 are slightly canted with respect to these rails to meet the perimeter requirements, possibly, of the area. At the same time, a fence section to the right comes in at right angles to a corner post 20 which is provided for that purpose. The corner post 20 differs from the in-line post 10 in that the openings 14 are not provided on surfaces that are opposite from each other but are provided on surfaces which are at right angles to each other, as best shown in FIGS. 12 and 14. As best shown in FIG. 12, the two rails involved come in at right angles to each other through their respective openings 14. The space to the right of the left-hand rail 12 and below the other rail 12 is therefore filled with a wooden spacer 16 in much the same manner as shown in FIGS. 7 and 9. It is desirable to lock the top of the corner post 20 in much the same manner as the locking of the end post 22 as in FIGS. 7 and 8. Therefore, FIG. 13 shows that the end post 20 is provided with a removable cap 18 with all the same locking mechanisms disclosed and described in connection with FIGS. 7 and 8.

Figure 2:
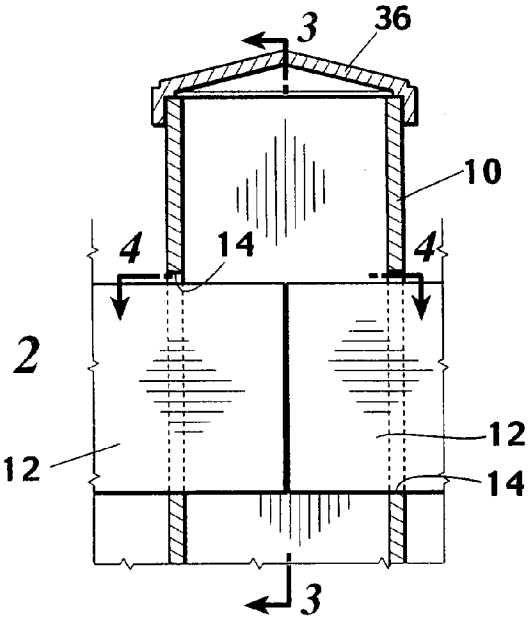
FIG. 2 is a sectional view, on a slightly enlarged scale, taken of the top of the post to the right in FIG. 1.

As shown in FIG. 2 when the two rails 12, which go into the post 10 through the openings 14, are horizontally disposed they will abut, preferably at the center, and preferably along a vertical line. The plan representation of FIG. 2 is shown in FIG. 4.

Figure 3:
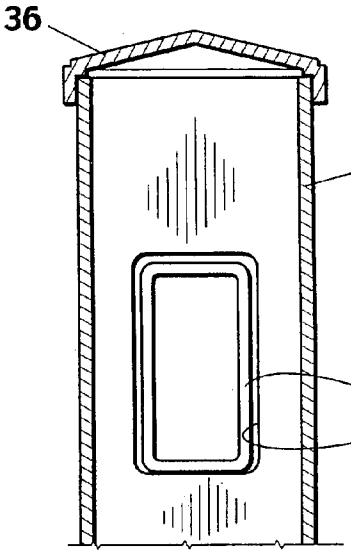
FIG. 3 is a sectional view taken along section line 3-3 of FIG. 2.
Figure 5:
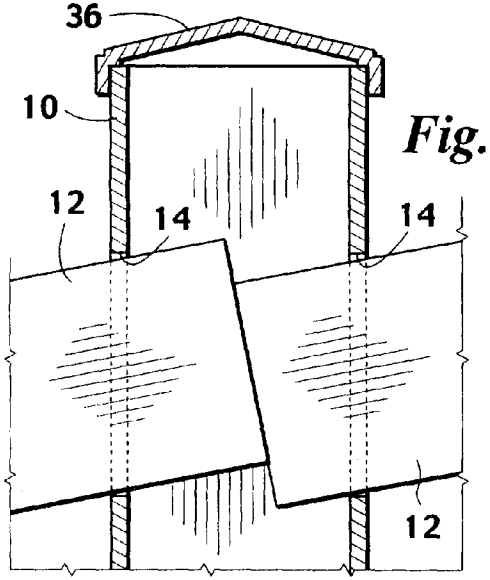
FIG. 5 is a view similar to FIG. 2 but showing where the post is on the middle of an incline and the rails are also inclined.

As best shown in FIG. 3, the opening 14 is slightly larger than the external shape or size of the rail 12. This feature is to allow the posts and rails to traverse uneven topography as shown in the center of FIG. 1. The dotted line positions of the rails 12 shown in FIG. 4 represent a condition where the rails are nonlinear or where there would be a curvature as would appear from the rail and post arrangement in FIG. 10. FIG. 5 represents a condition where the post 10 would be on the center of an incline and the rail 12 to the left of the post 10 in FIG. 5 was coming from a post that was in a lower position whereas the rail 12 on the right of FIG. 5 would be going from that post to a post on the right at a higher elevation. In the event that there is the cumulative error in the arrangement of the rail ends within the posts 10, a shim or spacer such as the spacer 16 (of any desired size) can be inserted where necessary, in which case, it may be desirable to use the locking end cap 18 shown in FIGS. 7, and 8.

Figure 16:
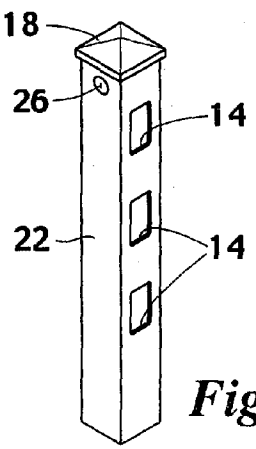
FIG. 16 is a view of the end post shown in FIGS. 7, 8 and 9.
Figure 15:
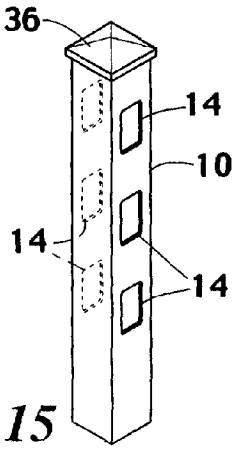
FIG. 15 is a perspective view of the in-line post shown in FIGS. 4, and 5.

FIGS. 14, 15 and 16 are merely perspective views of the three different posts using the fence of the present invention. Thus, FIG. 14 shows the corner post 20 with the openings 14 located on side portions that are at right angles to each other thereby permitting the rails 12 to come in at right angles to each other. FIG. 15 is the conventional end in-line post 10 which permits the rails to come in from opposite sides and abut in the center of the post 10. FIG. 16, on the other hand, is a view of the end post 22 which will be the last post in the line, and where the rails 12 come in from one side portion only and terminate somewhere between the two opposite side portions of the posts. In the case of FIG. 16, of course, there will be a need to use some kind of spacer 16 and a locking cap 18. The locking cap 18 is also used on the corner post 20 shown in FIG. 14.

The fence of the present invention permits the assembly of rails and posts without the necessity of any welding. In this regard, the posts and rails can be pre-painted or powder coated before being brought to the site where the fence is to be erected. Thus, the fence of the present invention can be just as attractive as the PVC fences. Although the fence of the present invention has been illustrated and described more particularly in relation to rectangular posts and rectangular rails, it should be understood that these posts and rails are primarily tubular and could be round tubular elements as well as rectangular or square tubular elements. Furthermore, because the fence is made of steel it will have considerably more strength than a wooden fence or a PVC fence.

Figure 19:
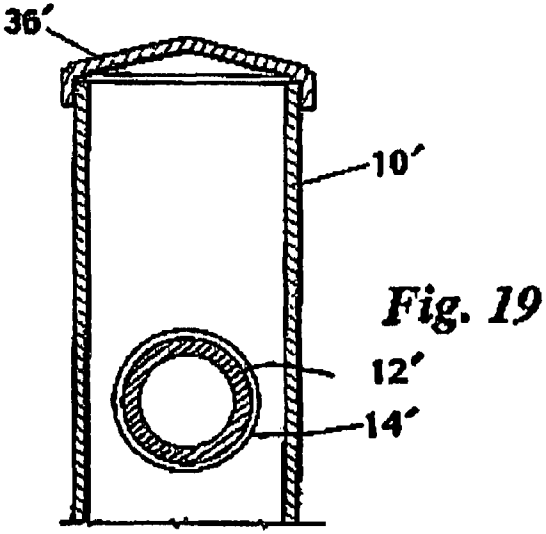
FIG. 19 is a longitudinal sectional view taken along section line 19-19 of FIG. 18.
Figure 18:
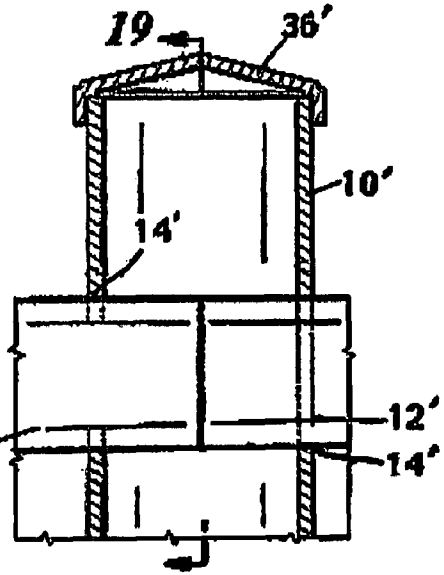
FIG. 18 is a sectional view, on an enlarged scale taken along circular section line 18 of FIG. 17.
Figure 17:
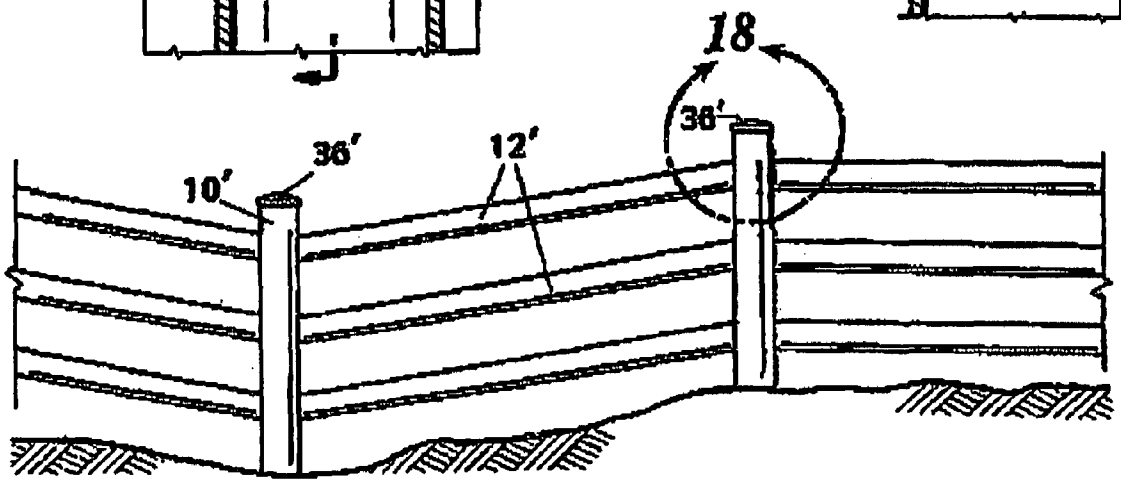
FIG. 17 is a view similar to FIG. 1 but showing a modification of the present invention wherein the posts and rails may be made from round steel tubular members, the posts having a greater external diameter than the rails.

Referring now to FIGS. 17 through 19 inclusive, there is shown an embodiment, such as referred to above, where the elements are round tubular members having curved vertical portions as opposed to the rectangular tubular members as depicted in the previous figures. More particularly, FIG. 17 shows a plurality of vertical round tubular posts 10' and a plurality of transverse or horizontal round rails 12'. The post 10' are of greater outside diameter than the rails 12' so as to permit the rails 12' to be inserted into an opening 14' in the post 10' in the same manner depicted and described in FIG. 1. The rails 12' are assembled into the posts in the same manner as described in relation to the earlier figures.

FIG. 18 is a sectional view taken along circular section line 18 of FIG. 17 which shows the round rails 12' inserted into round posts 10' such that the round rails 12' abut each other at the center of the round post 10' when fully inserted into the opening 14' therein.

FIG. 19 is a longitudinal sectional view taken along section line 19-19 of FIG. 18 showing a round rail 12' fitted into the corresponding round opening 14' in the round post 10', and the round post 10' being fitted with a round cap 36' which round cap may be placed at the top of the round post 10' or, in the alternative, may be tack welded onto the round post 10' if desired.

Whereas the present invention has been described in particularly relation to the drawings attached hereto, it should be understood that other and further modifications of the present invention, apart from those shown or suggested herein may be made within the spirit and scope of this invention.

What is claimed is:

1. An interlocking and anti-theft steel fencing system comprising a plurality of tubular steel posts vertically supported from a ground and horizontally spaced and a plurality of horizontal tubular steel rails connected between the posts, at least one of the posts being an in-line post, the in-line post being provided with opposite vertical side portions, the in-line post having openings on one side portion and openings on an opposite side portion for receiving therein the ends of rails which connect to the in-line post, the openings being of essentially the same shape as the outside shape of the horizontal rails but being slightly larger to permit canting of the ends of the rails in the openings, the rails being fitted into the in-line post so that the rails coming in from opposite sides of the in-line post through the openings are in abutting relation within the in-line post, at least one of said posts constituting and end post, the end post having openings along one side surface portion only of the end post for receiving therein the ends of rails connected to the end post, the openings on the end post being of the same shape and slightly larger than the outer periphery of the rails connecting into the end post, the end post having its rails extending inwardly less then the full width of the end post, a vertical spacer extending essentially the full height of the end post between the ends of the rails and the inside portion of the end post opposite from the openings therein, a post cap received over the top of the end post when the spacer is in position; and means for locking the post cap securely in place on the top of the end post.

2. A steel fencing system as set forth in claim 1 wherein the means for locking the post cap to the top of the end post is a key-actuated lock.

3. An interlocking and anti-theft steel fencing system as set forth in claim 1 wherein at least one of said posts is a corner post, the corner post having vertically spaced openings along a first side portion thereof for receiving the ends of rails therein, the openings being of same shape but slightly larger than the outer periphery of the rails, the corner post having a second side portion adjacent to the first side portion wherein a plurality of spaced openings are provided for receiving the ends of rails therein, the rails which are received in the openings in the first side surface portion abutting at an angle with the rails received in the openings in the second side surface portion.

4. An interlocking steel fencing system as set forth in claim 1 wherein the tubular steel posts are round, wherein the horizontal tubular steel rails are round, wherein the tubular steel posts are of sufficiently larger external diameter so as to receive the ends of the round rails therein and wherein at least one of said posts is a corner post, the corner post having vertically spaced openings along a first vertical side portion thereof for receiving the ends of rails therein, the openings being of same shape but slightly larger than the outer periphery of the rails, the corner post having a second side portion adjacent to the first side portion wherein a plurality of spaced openings are provided for receiving the ends of rails therein, the rails which are received in the openings in the first side portion abutting at an angle with the rails received in the openings in the second side portion.

5. An interlocking and anti-theft steel fencing system comprising a plurality of tubular steel posts vertically supported from a ground and horizontally spaced and a plurality of horizontal tubular steel rails connected between the posts, at least one of the posts being an in-line post, the in-line post being provided with opposite vertical side portions, the in-line post having openings on one side portion and openings on an opposite side portion for receiving therein the ends of rails which connect to the in-line post, the openings being of essentially the same shape as the outside shape of the horizontal rails but being slightly larger to permit canting of the ends of the rails in the openings, the rails being fitted into the in-line post so that the rails coming in from opposite sides of the in-line post through the openings are in abutting relation within the in-line post, at least one of said posts constituting and end post, the end post having openings along one side surface portion only of the end post for receiving therein the ends of rails connected to the end post, the openings on the end post being of the same shape and slightly larger than the outer periphery of the rails connecting into the end post, the end post having its rails extending inwardly less then the full width of the end post, a vertical spacer extending essentially the full height of the end post between the ends of the rails and the inside portion of the end post opposite from the openings therein, a post cap received over the top of the end post when the spacer is in position; and means for locking the post cap securely in place on the top of the end post, wherein the means for locking the post cap to the top of the end post is a key-actuated lock, and wherein the key-actuated lock includes a shaft having a finger mounted thereon, the finger being provided with a hook at an end thereof, the cap having a circular eye mounted thereon and extending at an angle inwardly, the hook being intercepted by the eye, a key and a corresponding key slot in the shaft which operates in the conventional manner of a tumbler type lock to turn the shaft when the key is inserted and rotated therein.

* * * * *